US005253856A

United States Patent [19]

Fuchi et al.

[11] Patent Number: 5,253,856

[45] Date of Patent: Oct. 19, 1993

[54] SHEET TRANSPORT DEVICE

[75] Inventors: Masami Fuchi, Neyagawa; Hiroshi Kubota, Osaka; Kenji Oda, Toyonaka, all of Japan

[73] Assignee: Mita Industrial Co., Ltd., Osaka, Japan

[21] Appl. No.: 889,013

[22] Filed: May 26, 1992

[30] Foreign Application Priority Data

May 30, 1991 [JP] Japan ..... 3-127574

[51] Int. Cl.[5] ..... B65H 3/44

[52] U.S. Cl. ..... 271/9; 271/10; 271/116; 198/570; 198/577

[58] Field of Search ..... 271/9, 10, 110, 111, 271/116; 198/570, 575, 577

[56] References Cited

U.S. PATENT DOCUMENTS 3,375,003 3/1968 Godlewski ..... 271/9
4,855,794 8/1989 Suzuki ..... 271/9 X

FOREIGN PATENT DOCUMENTS 0186842 10/1984 Japan ..... 271/10
0188356 8/1986 Japan ..... 271/9
0247336 10/1989 Japan ..... 271/116
0247337 10/1989 Japan ..... 271/116
0204237 8/1990 Japan ..... 271/9

*Primary Examiner*—H. Grant Skaggs
*Assistant Examiner*—Carol Lynn Druzbick
*Attorney, Agent, or Firm*—Jordan and Hamburg

[57] ABSTRACT

A sheet transport device is provided with a plurality of sheet transport paths arranged in parallel to one another and a sheet transport assembly for transporting a sheet along the sheet transport path. The transport assembly includes a drive shaft extending normal to the plurality of sheet transport paths, a roller member mounted on the drive shaft in a position corresponding to each of the plurality of sheet transport paths, and a transmission mechanism provided between the drive shaft and roller member for transmitting the rotational force of the drive shaft rotating in a sheet transport direction to the roller member and for shutting off transmission of the rotational force of the roller member rotating in the sheet transport direction to the drive shaft. Accordingly, the misalignment of sheets to be transported simultaneously can be readily corrected. In addition, even if one of the simultaneously transported sheets gets jammed, the jammed sheet can be smoothly removed without affecting transport of the other sheets.

2 Claims, 12 Drawing Sheets

SHEET TRANSPORT DEVICE

FIELD OF THE INVENTION

This invention relates to a sheet transport device for use in a printer, copying machine or like image forming apparatus.

BACKGROUND OF THE INVENTION

There have been known a number of sheet transport devices for use in a printer or like image forming apparatus in which data such as addresses successively output from a data storage provided in a personal computer or the like are printed on printing material. One of those sheet transport devices is, as shown in FIGS. 10 and 11, constructed such that sheets contained in two containers 101, 102 defined in a cassette 100 are dispensed and transported side by side by a feed roller 104 including a plurality of roller members fixed to a drive shaft 103 which is drivingly rotated by unillustrated drive means.

In the sheet transport device as described above, sheets dispensed from the cassette 100 are fed by the feed rollers 104 and transported to a pair of transport rollers 108 by way of a pair of separating rollers 107. The separating roller pair 107 include a forward roller 105 and a retard roller 106 which are respectively rotatable in directions along and against transport of sheet. Thereafter, registration sensors 109 disposed in specified positions along respective sheet transport paths detect the presence of the sheets fed from the containers 101, 102. Upon lapse of a predetermined period following detection of the presence of both sheets by the sensors 109, a pair of registration rollers 110 are driven to transport the sheets to a photosensitive drum 111. In synchronism with the driving of the registration rollers 110, the driving of the feed roller 104 is stopped.

There are cases where the sheets 112*a*, 112A may be dispensed from the containers 101, 102 at different timings for some causes and transported to a downstream side with one sheet 112A slightly delayed relative to the other 112*a*, i.e. misaligned, as shown in FIG. 12. However, even if the sheets are transported toward the registration rollers 110 in this state, the registration rollers 110 are not driven until the presence of both sheets 112*a*, 112A is detected by the registration sensors 109 as described above. Accordingly, the transport of the sheet 112*a* going ahead is suspended with the leading edge of the sheet 112*a* at the registration rollers 110 until the presence of the delayed sheet 112A is detected by the corresponding sensor 109. The delayed sheet 112A reaches the registration rollers 110 while the transport of the sheet 112*a* is suspended, thereby correcting the misalignment of sheets. Normally, the misalignment caused in dispensing the sheets from the containers is corrected in the above manner. However, since the transport rollers 108 are kept rotating while the transport of the sheet 112*a* is suspended, a trailing edge of the sheet 112*a* is kept transported while warping. Accordingly, although the leading edges of the sheets 112*a* and 112A are aligned by operational relationship of the registration rollers 110 and registration sensors 109, the trailing edges thereof are kept misaligned. More specifically, the sheets 112*a*, 112A may be nipped by the feed roller 104 with the trailing edges thereof misaligned. Alternatively, as shown in FIG. 12, the trailing edge of the sheet 112*a* may be released from the feed roller 104 while that of the sheet 112A may be nipped thereby. If the driving of the feed roller 104 is stopped in these states, the respective sheets 112*a*, 112A are pulled and moved by rotation of the transport rollers 108. At this time, a roller member 104A of the feed roller 104 in contact with the delayed sheet 112A rotates due to the frictional force with the sheet 112A and the drive shaft 103 rotates together with the roller member 104A. Accordingly, a next sheet 112*b* contained in the container 102 is dispensed by an amount of misalignment of the sheets 112*a*, 112A according to rotation of the drive shaft 103 since the roller member 104*a* is fixed to the drive shaft 103. Thus, the misalignment of sheets occurs in the succeeding sheet transport as well. Particularly in a continuous printing operation, once the misalignment occurs, it occurs in succession. This may cause frequent occurrences of a jam, smear, and damage of sheets.

Further, the above sheet transport device in which the sheets are transported side by side suffers the following problems. In the case where one of the sheets is jammed when dispensed by the feed roller, the driving of the feed roller is stopped to facilitate removal of the jammed sheet. When the jammed sheet is pulled out of the container in a sheet transport direction, the roller member of the feed roller in contact with the jammed sheet and the drive shaft rotate together, resulting in rotation of the other roller member. Accordingly, the sheet contained in the other container is inadvertently dispensed according to rotation of the drive shaft.

The same problem arises in the case where either one of the sheets is jammed while being transported after fed from the containers. When the jammed sheet is removed, the other sheet is inadvertently pulled out together with the jammed sheet.

SUMMARY OF THE INVENTION

It is an object of the invention to provide a sheet transport device capable of settling the aforementioned problems.

Accordingly, the invention is directed to a sheet transport device comprising a plurality of sheet transport path means arranged in parallel to one another and transport means for transporting a sheet along the sheet transport path means, the transport means including a drive shaft extending normal to the plurality of sheet transport path means, roller means mounted on the drive shaft in a position corresponding to each of the plurality of sheet transport path means, and transmission means provided between the drive shaft and roller means for transmitting the rotational force of the drive shaft rotating in a sheet transport direction to the roller means and for shutting off transmission of the rotational force of the roller means rotating in the sheet transport direction to the drive shaft.

With the sheet transport device thus constructed, when the drive shaft is rotated in the sheet transport direction, the rotational force thereof is transmitted to the respective roller means and thereby a plurality of sheets are transported side by side. In the case where misalignment of sheets occurs in dispensing the sheets and the delayed sheet is pulled by downstream located rollers, or in the case where a jam occurs in a position where the roller means is disposed and the jammed sheet is pulled in the sheet transport direction to be removed, the roller means in contact with the delayed or jammed sheet is rotated due to the frictional force with the same. However, as the rotational force of this roller means is not transmitted to the drive shaft, only this roller means is idly rotated without causing other roller means to rotate. Accordingly, the delayed or jammed sheet can be smoothly pulled. Likewise, in the case where the misalignment of sheet or jam occurs along any of the parallel arranged transport paths, the misalignment can be corrected or the jam can be handled without affecting transport of sheets along the other transport paths.

These and other objects, features and advantages of the present invention will become more apparent upon a reading of the following detailed description and accompanying drawings.

DETAILED DESCRIPTION OF PREFERRED EMBODIMENTS OF THE INVENTION

A first embodiment of the invention will be described with reference to FIGS. 1 to 5.

Figure 2:
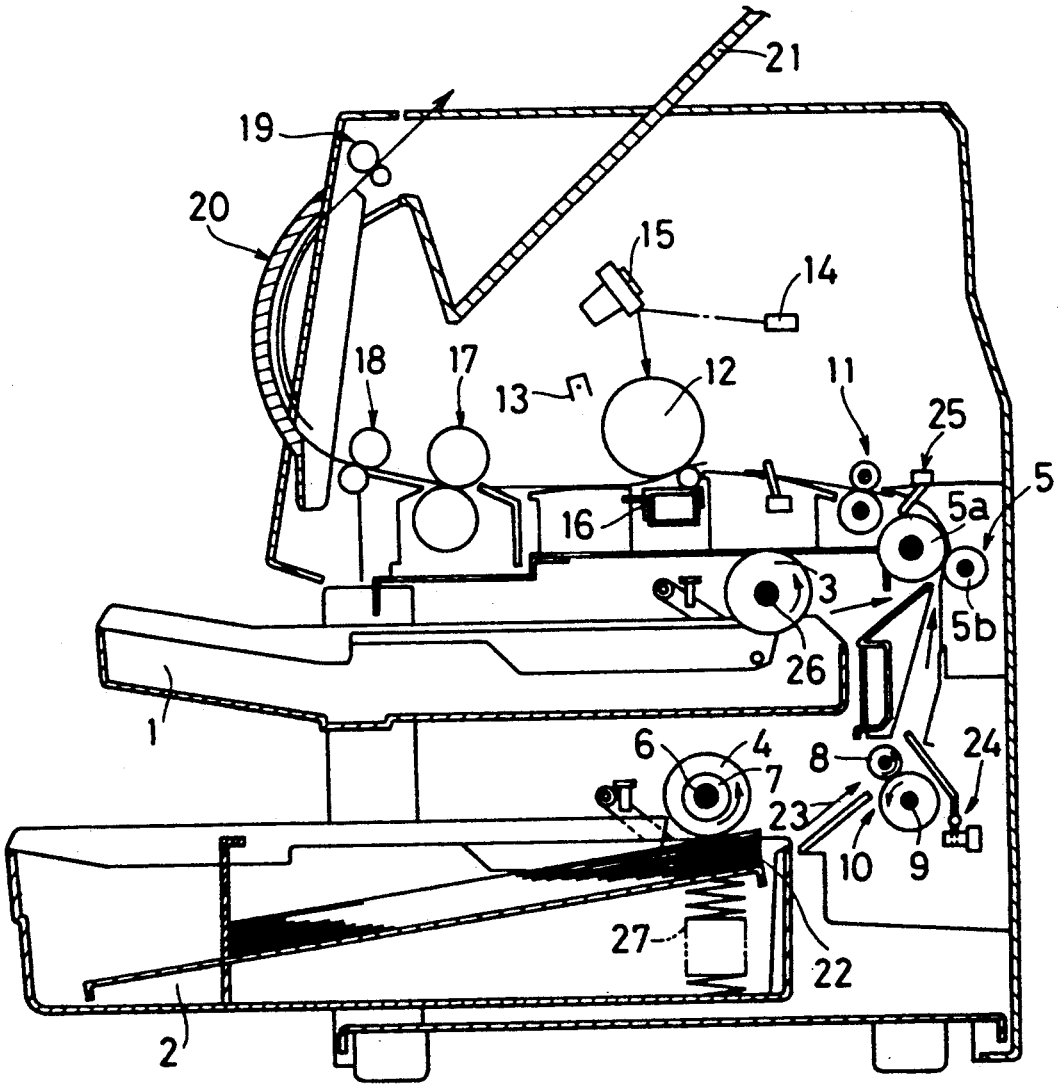
FIG. 2 is a schematic diagram showing a construction of an image forming apparatus incorporating the first sheet transport device.
Figure 3:
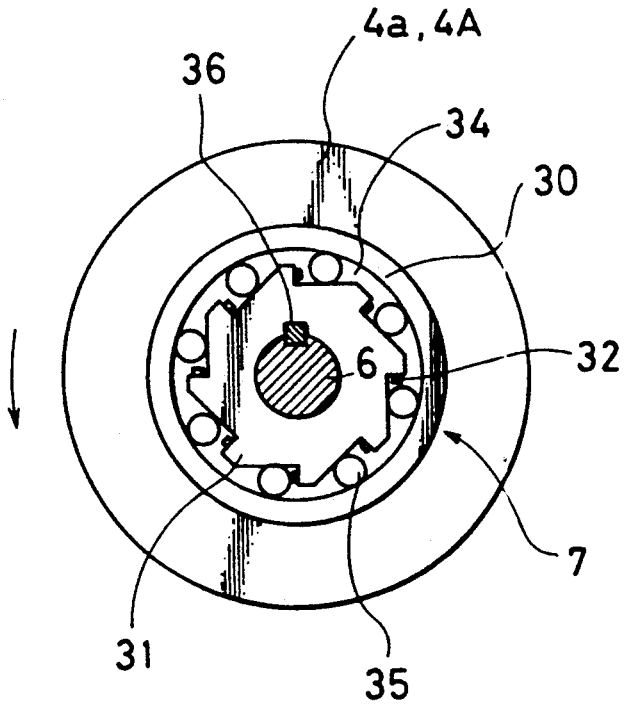
FIG. 3 is a side view showing an inner ring cam roller clutch used in the first sheet transport device.

FIG. 2 is a schematic diagram showing a construction of an image forming apparatus incorporating a first sheet transport device in accordance with the invention. To the apparatus are detachably mounted a cassette 1 for containing ordinary flimsy sheets therein and a cassette 2 including two containers each for containing therein narrow-dimensioned sheets such as envelops, the two containers being arranged in juxtaposition with each other in a direction normal to a sheet transport direction. The cassettes 1 and 2 are arranged vertically in the drawing of FIG. 2. At positions of the cassettes 1 and 2 where the sheets are dispensed are disposed feed rollers 3 and 4 respectively. Right downstream of a mounting position of the cassette 1 are disposed a pair of transport rollers 5. Further, right downstream of a mounting position of the cassette 2 are disposed a pair of separating roller 10 including a forward roller 8 and a retard roller 9. The forward roller 8 and retard roller 9 respectively rotate in direction along and against transport of the sheet, and thereby the forces working in opposite directions are given to front and rear faces of the sheet when the sheet passes between the separating rollers 10. Accordingly, in the case where a plurality of sheets are fed with one sheet adhered to another, i.e. in case of multiple feeding, the sheets are separated and the feeding of the sheets except the uppermost one is deterred.

Figure 1:
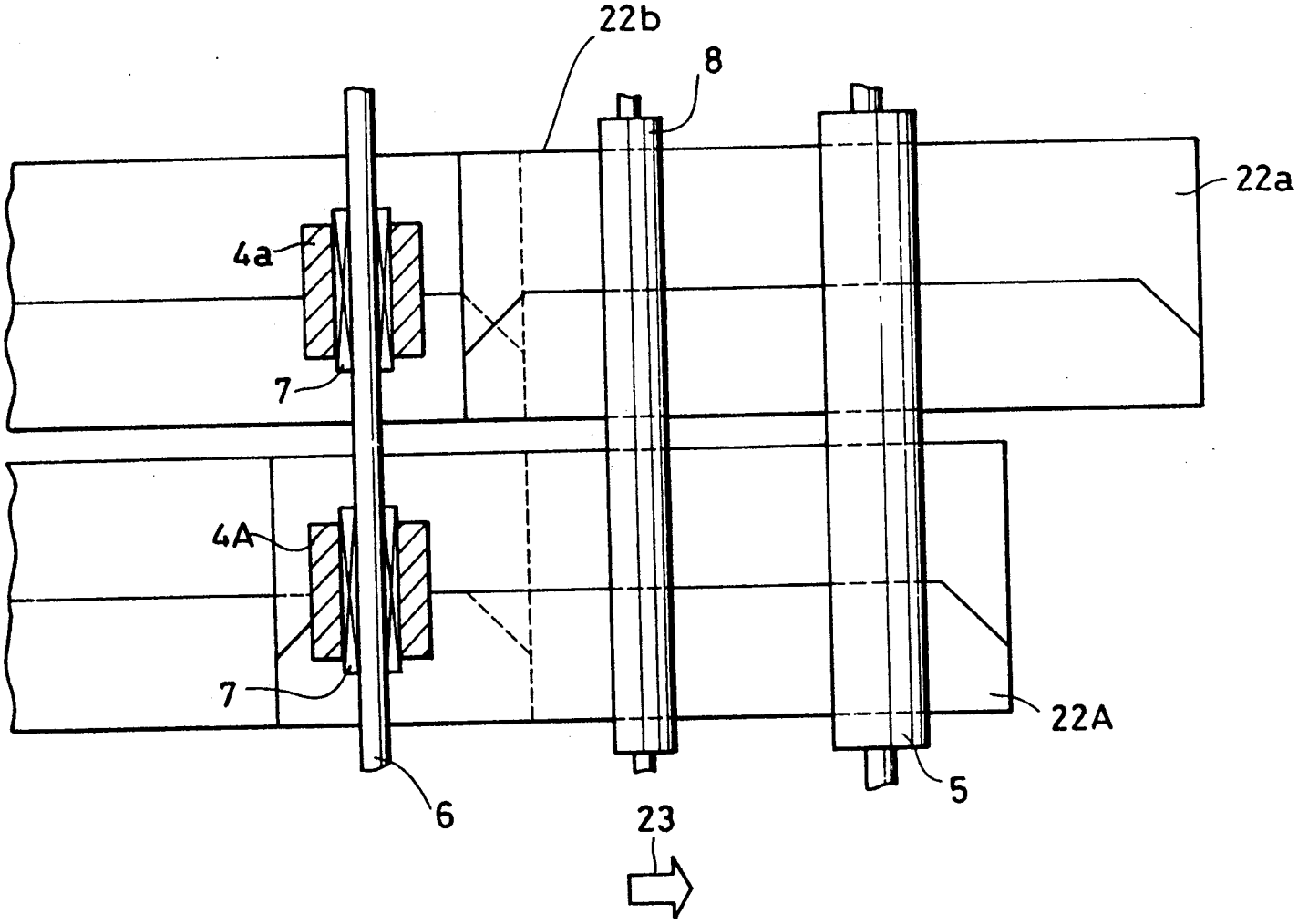
FIG. 1 is a diagram showing transport paths of a first sheet transport device in accordance with the invention which are developed into a plane to show sheets in transported states thereof.

The feed rollers 3 and 4 are mounted on drive shafts 6, 26 which are drivingly rotated by an unillustrated drive means such as a motor. The lower-located feed roller 4, as shown in FIG. 1, includes two roller members 4*a*, 4A arranged at specified spacing along the drive shaft 6 so that the sheets contained in the respective containers defined in the cassette 2 can be individually dispensed and fed side by side. Between the drive shaft 6 and each roller member of the feed roller 4 is provided a one-way clutch 7 for transmitting the rotational force of the drive shaft 6 driven in a sheet transport direction 23 to the feed roller 4 and for shutting off transmission of the rotational force of the drive shaft 6 driven in a direction opposite to the direction 23 (hereinafter referred to as a reverse direction) to the feed roller 4. In this embodiment, the one-way clutch 7 includes a well-known inner ring cam roller clutch. The inner ring cam roller clutch consists essentially of a cylindrical outer ring 30, cylindrical inner ring cam 31, and a plurality of rollers 35. The inner ring cam 31 is fitted inside the outer ring 30 and has a cross-section in the shape of a milling cutter. The rollers 35 are each rotatably arranged between the outer ring 30 and recesses defined by two adjacent teeth of the inner ring cam 31. Each roller 35 is biased toward a narrow section 34 by an unillustrated spring provided between a piston 32 and inner ring cam 31. On an outer circumferential surface of the outer ring 30 is fixed the roller member of the feed roller 4. The inner ring cam 31 and drive shaft 6 rotate together since a key 36 is mounted to prevent relative movement thereof. In the case where the drive shaft 6 is rotated in the sheet transport direction 23 (an arrow direction in FIG. 3) or the feed roller 4 is rotated in the reverse direction, the plurality of rollers 35 are pushed by the pistons 32 and moved toward the narrow sections 34, thereby getting stuck between the inner ring cam 31 and outer ring 30. As a result, the cam 31 and ring 31 are engaged with each other and the drive shaft 6 and feed roller 4 rotate together because the rotational force of the drive shaft 6 is transmitted to the feed roller 4 and vice versa. On the other hand, in the case where the drive shaft 6 is rotated in the reverse direction or the feed roller 4 is rotated in the sheet transport direction 23, the rollers 35 push corresponding pistons and move away from the narrow sections 34. As a result, the cam 31 and ring 31 are disengaged from each other and the drive shaft 6 and feed roller 4 rotate individually.

In the sheet transport device thus constructed, sheets 22 contained in the cassette 2 are biased upward by a spring 27 and thereby pressed against the feed roller 4. When the drive shaft 6 is rotated in the sheet transport direction 23 in this state, the rotational force thereof is transmitted to the respective roller members 4*a*, 4A of the feed roller 4 through the one-way clutches 7. Then, the feed roller 4 is drivingly rotated and uppermost sheets in the respective containers of the cassette 2 are simultaneously dispensed and transported side by side with leading edges thereof aligned to a pair of registration rollers 11 by way of the separating rollers 10 and transport rollers 5. In the case ordinary sheets are fed from the cassette 1, the transport roller pair 5 are controlled such that respective rollers are rotated in opposite directions, thereby functioning as separating roller pair. Accordingly, the separated sheets are transported to the registration rollers 11 one by one in case of multiple feeding.

Downstream of the registration rollers 11 is disposed a photosensitive drum 12. Around the drum 12 are arranged an image forming unit including a charger 13, light emitter 14, polygonal mirror 15, transfer device 16 and the like. Downstream of the drum 12 are arranged a fixing device 17, pairs of discharge rollers 18, 19, discharge guide 20, discharge tray 21, etc.

In specified positions along respective transport paths extending from the cassettes 1, 2 to the registration rollers 11 are disposed multifeed sensors 24 for detecting multifeeding of sheets, registration sensors 25 whose detections are made to time the driving of the registration rollers 11 and other sensors. Two each of these sensors are transversely arranged with respect to the sheet transport direction 23 so as to respectively detect two sheets being transported side by side.

In the image forming apparatus thus constructed, for example, the sheets in the cassette 2 are transported by way of the separating rollers 10 and transport roller 5 to the registration rollers 11 where the leading edges of the juxtaposed sheets are aligned. Subsequently, these sheets are transported to the transfer device 16 in vicinity of the photosensitive drum 12. Then, after passing through the fixing device 17, the sheets are discharged onto the discharge tray 21 through the discharge roller pairs 18, 19 and discharge guide 20.

Figure 4:
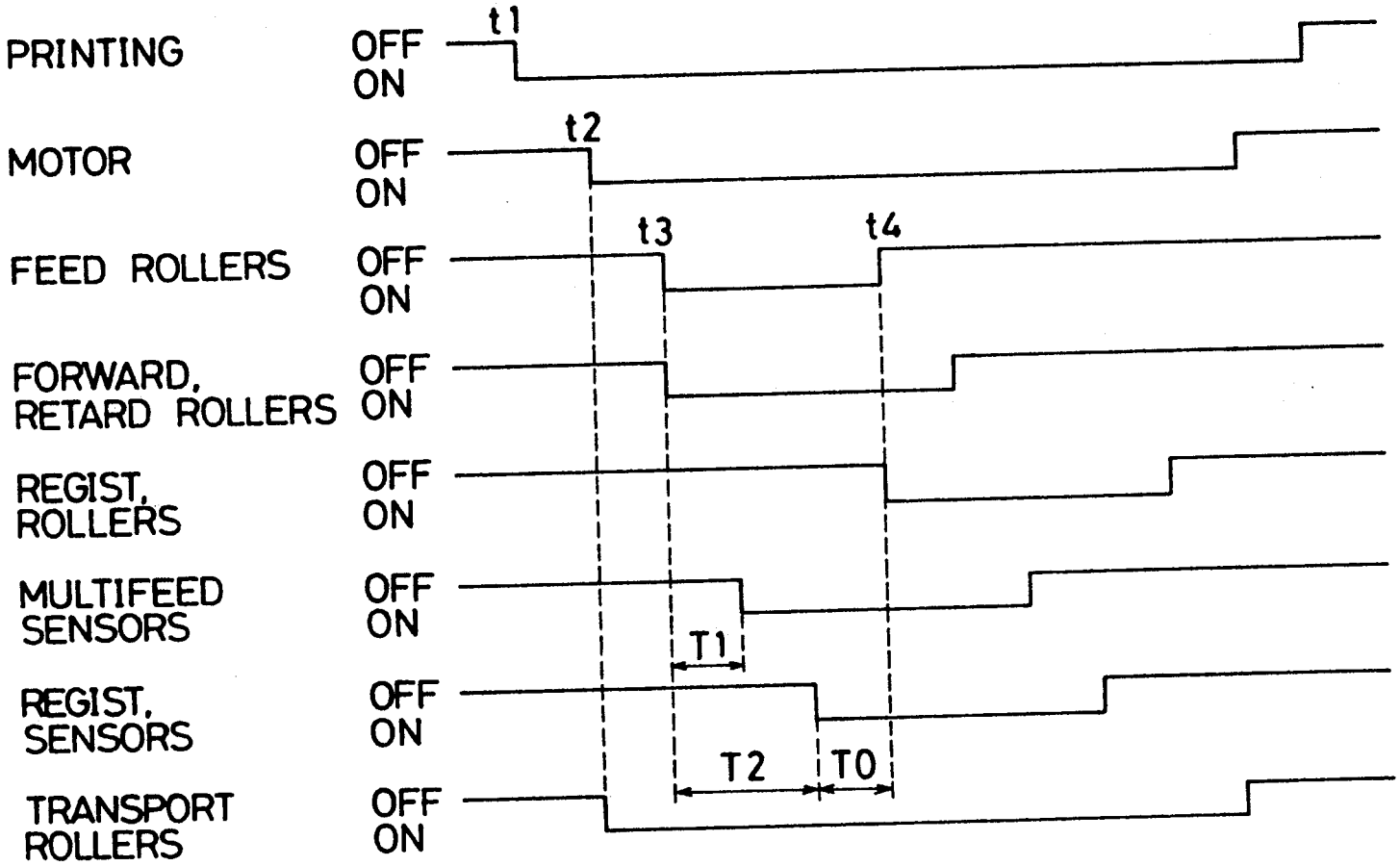
FIG. 4 is a timing chart showing operations of the first sheet transport device.
Figure 5:
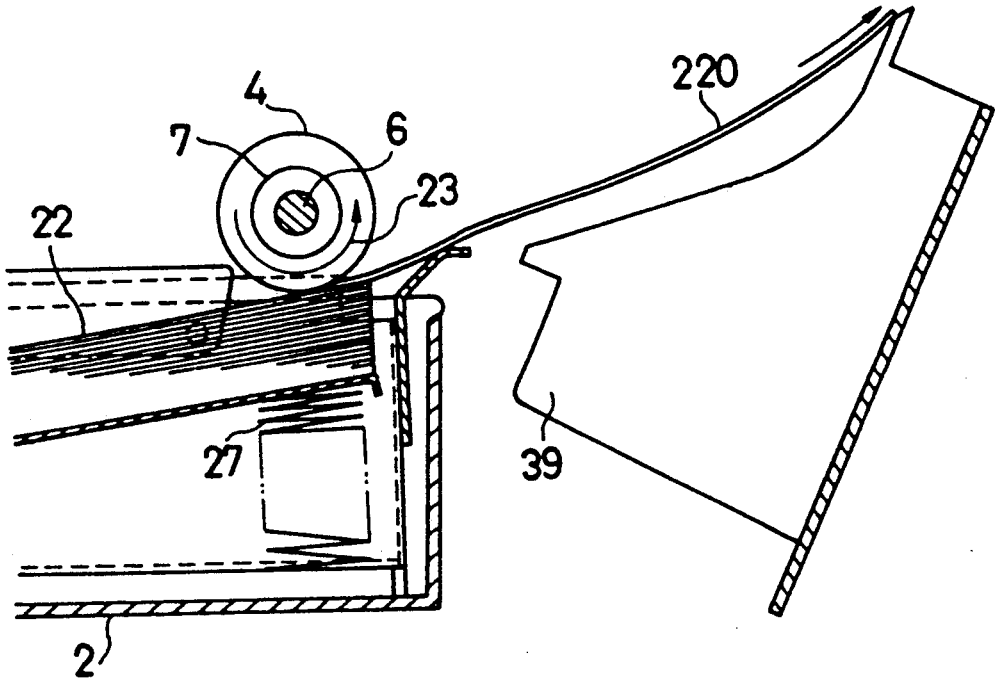
FIG. 5 is a diagram showing essential parts of the first sheet transport device when a cover defining transport paths is in an open state.

Next, operations of the first sheet transport device will be described with reference to FIGS. 1 and 4. FIG. 1 is a diagram showing transport paths of the first sheet transport device which are developed into a plane to show sheets in transported states thereof. Specifically, FIG. 1 shows a case where one sheet is fed from the cassette 2 with slightly delayed relative to the other due to some error caused by the feed roller 4 in dispensing the sheets. FIG. 4 is a timing chart showing operations of the first sheet transport device.

It will be appreciated that timings at which the respective sensors make specified detections and the respective rollers are driven are controlled by an unillustrated central processing unit so that the first sheet transport device follows a preset operation flow.

Referring to FIG. 4, upon start of a printing operation at time t1, a motor serving as drive means is activated at time t2, driving the transport rollers 5. At time t3, the driving of the feed roller 4 is started to dispense the sheets from the cassette 2, and the driving of the forward roller 8 and retard roller 9 is started. The rollers 8, 9 transport the sheets, while separating the same in case of multiple feeding, to the registration rollers 11 by way of the transport rollers 5. While transported, the sheets successively pass the multifeed sensors 24 and registration sensors 25 to turn them on. Unless the sensors 24 and 25 are respectively turned on within predetermined periods T1 and T2 after time t3, it is determined that a jam has occurred and occurrence thereof is informed of an operator by means of a warning displayed in an unillustrated display unit. It is determined that the sheets have reached a nip between the registration rollers 11 upon lapse of a predetermined period T0 following turning-on of the registration sensors 25, and the driving of the registration rollers 11 is started to introduce the sheets to the photosensitive drum 12. Simultaneously with the driving of the registration rollers 11, the driving of the feed roller 4 is stopped.

If, as shown in FIG. 1, the misalignment of two sheets **22*a*, 22A occurs due to some error caused by the feed roller 4 in dispensing the same, the sheets 22*a*, 22A are transported to the separating rollers 10 and transport rollers 5 with the sheet 22A delayed relative to the other 22*a*. For instance, the delayed sheet 22A passes the corresponding registration sensor 25 turning it on and the driving of the registration rollers 11 is started and that of the feed roller 4 is stopped at time t4. If a rear portion of the sheet 22A is nipped by the feed roller 4 at time t4, the sheet 22A is pulled and moved by the still rotating transport rollers 5 since the feed roller 4 is not driven. At this time, due to the frictional force with the sheet 22A, the roller member 4A of the feed roller 4 in contact therewith is rotated in the direction 23 while the sheet 22A is pulled forward. Even if one roller member of the feed roller 4 is rotated in the direction 23, the drive shaft 6 is not driven together therewith since the transmission of the rotational force thereof is shut off by the one-way clutch 7. As a result, only the roller member 4A is idly rotated. Accordingly, the sheet 22A is fed without dispensing a sheet 22*b* succeeding the sheet 22*a*** from the corresponding container.

Also, in the case where the occurrence of a jam in a position where the feed roller 4 is disposed is informed by means of the unillustrated display unit, the operator can remove the jammed sheet in the following manner. Firstly, a cover 39 defining the transport paths is moved to the right in the drawing of FIG. 5 so as to open up the transport paths. Then, a jammed sheet 220 is pulled toward the sheet transport direction 23 and removed.

The similar effect obtainable when the misaligned sheets are fed from the cassette is also obtainable in removing the jammed sheet 220. Specifically, in the removal of the jammed sheet 220, the jammed sheet 220 is pulled out while only the roller member of the feed roller 4 in contact therewith is idly rotated. Accordingly, jamming can be handled without dispensing the sheet contained in the other container.

Next, a second embodiment of the invention will be described with reference to FIGS. 6 to 8.

Figure 6:
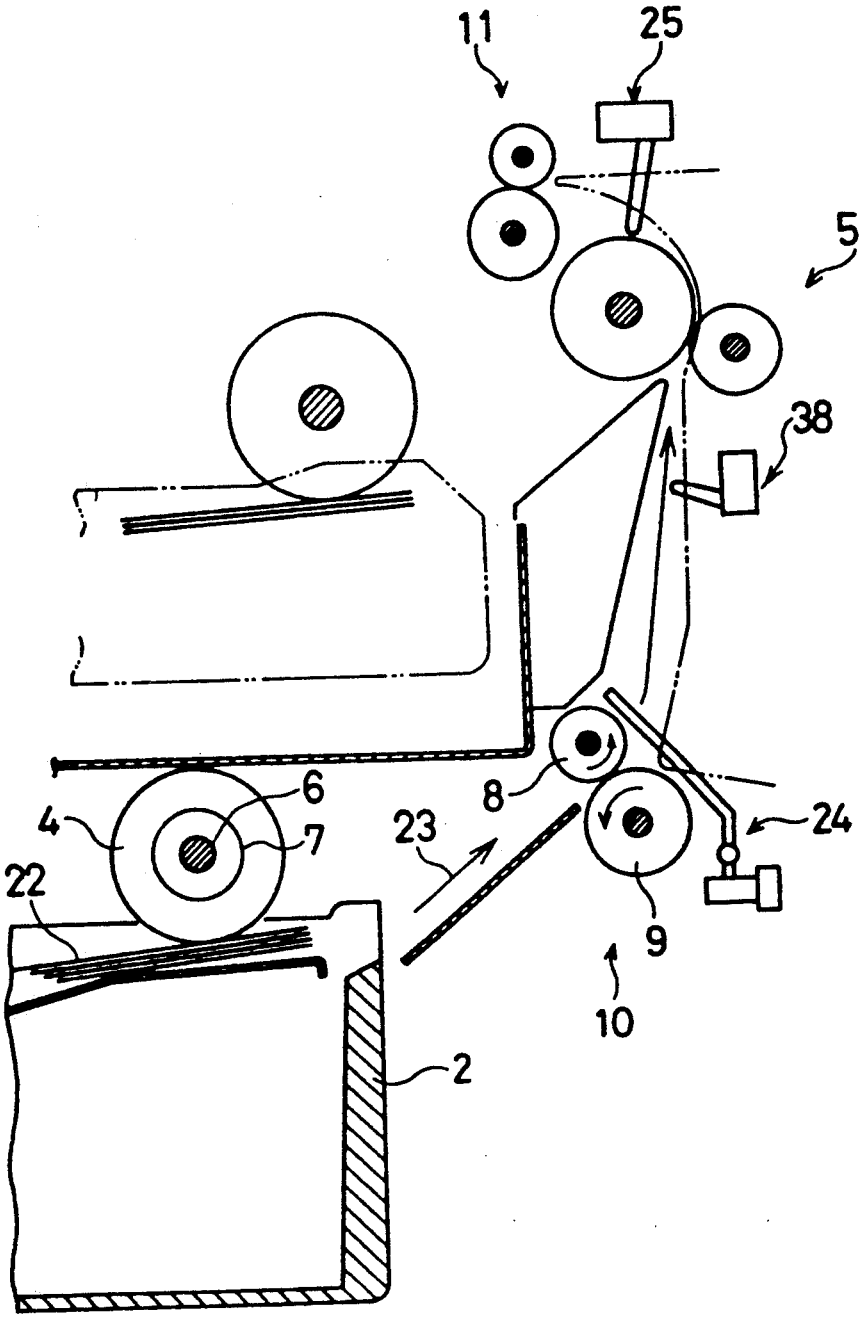
FIG. 6 is a diagram showing essential parts of an image forming apparatus incorporating a second sheet transport device in accordance with the invention.

FIG. 6 is a diagram showing essential parts of an image forming apparatus incorporating a second sheet transport device in accordance with the invention; FIG. 7 is a timing chart showing operations of the second sheet transport device; FIG. 8 is a diagram showing transport paths of the second sheet transport device which are developed into a plane to show sheets in transported states thereof at time t9 in FIG. 7. It will be appreciated that like numerals designate like parts in the first and second embodiments because a basic construction of the image forming apparatus incorporating the second sheet transport device is similar to that of the first embodiment.

Figure 7:
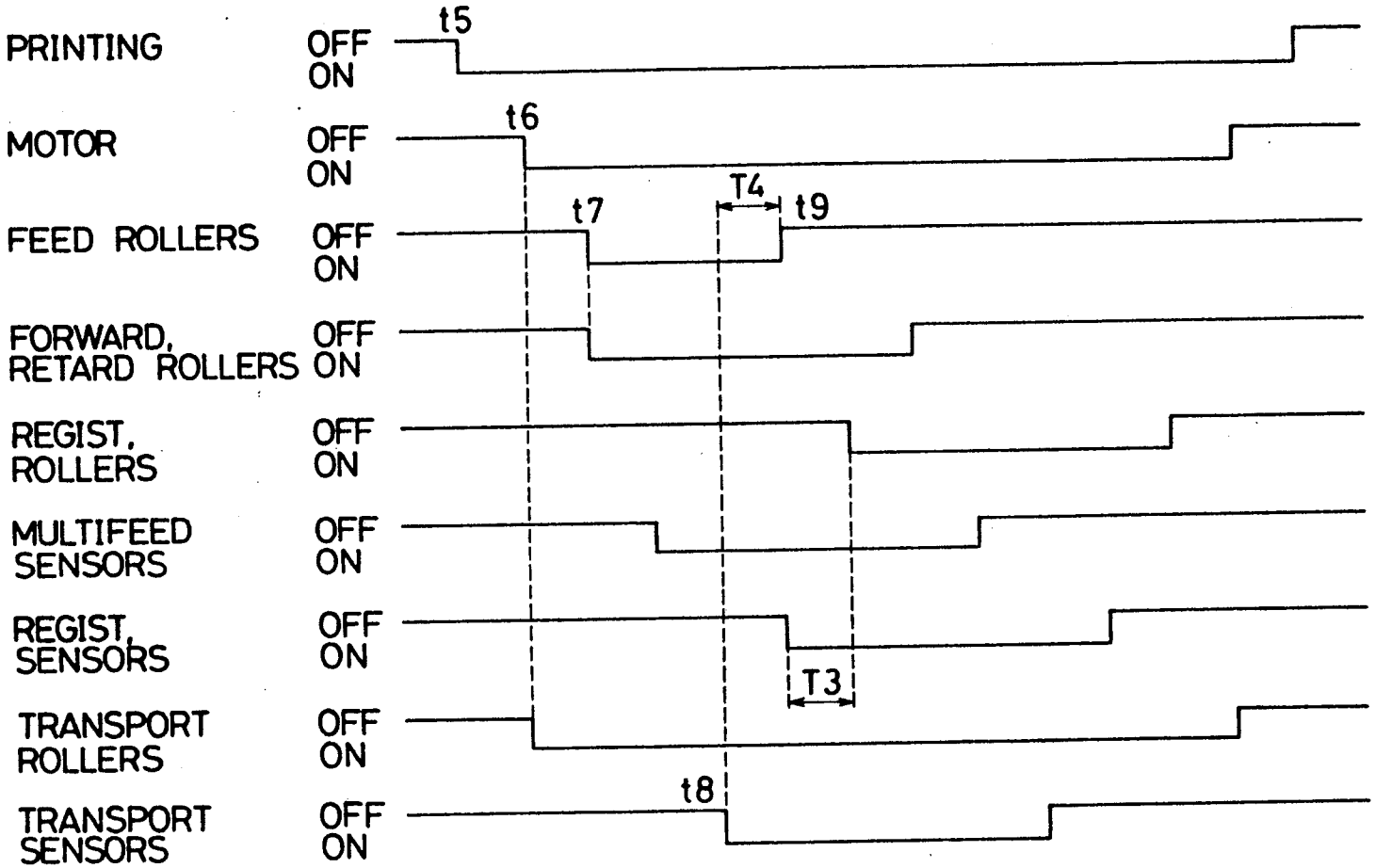
FIG. 7 is a timing chart showing operations of the second sheet transport device.

With reference to FIG. 7, upon start of a printing operation at time t5, a motor is activated at time t6, thereby driving a pair of transport rollers 5. At time t7, the driving of a feed roller 4 is started to dispense the sheets from a cassette 2, and the driving of a forward roller 8 and a retard roller 9 is started. The rollers 8, 9 transport the sheets, while separating the same in case of multiple feeding, to a pair of registration rollers 11 by way of the transport rollers 5. While transported, the sheets sucessively pass multifeed sensors 24, transport sensors 38 and registration sensors 25 to turn them on. As shown in FIG. 6, there are two transport sensors 38 arranged transversely in positions right upstream of the transport rollers 5 to detect leading edges of the sheets. The sensors 38 are turned on upon detecting the leading edges of the sheets and detection thereof is used to measure a stop timing of the driving of the feed roller 4. More specifically, the driving of the feed roller 4 is stopped upon lapse of a predetermined time T4 following turning-on of the transport sensors 38. The predetermined time T4 is a time sufficient for the leading edges of the sheets to travel from the sensor 38 to the transport rollers 5. Further, it is determined that the both sheets have reached the nip between the registration rollers 11 upon lapse of a predetermined time T3 following turning-on of the both registration sensors 25, and then the driving of the registration rollers 11 is started to transport the sheets to a further downstream side.

Figure 8:
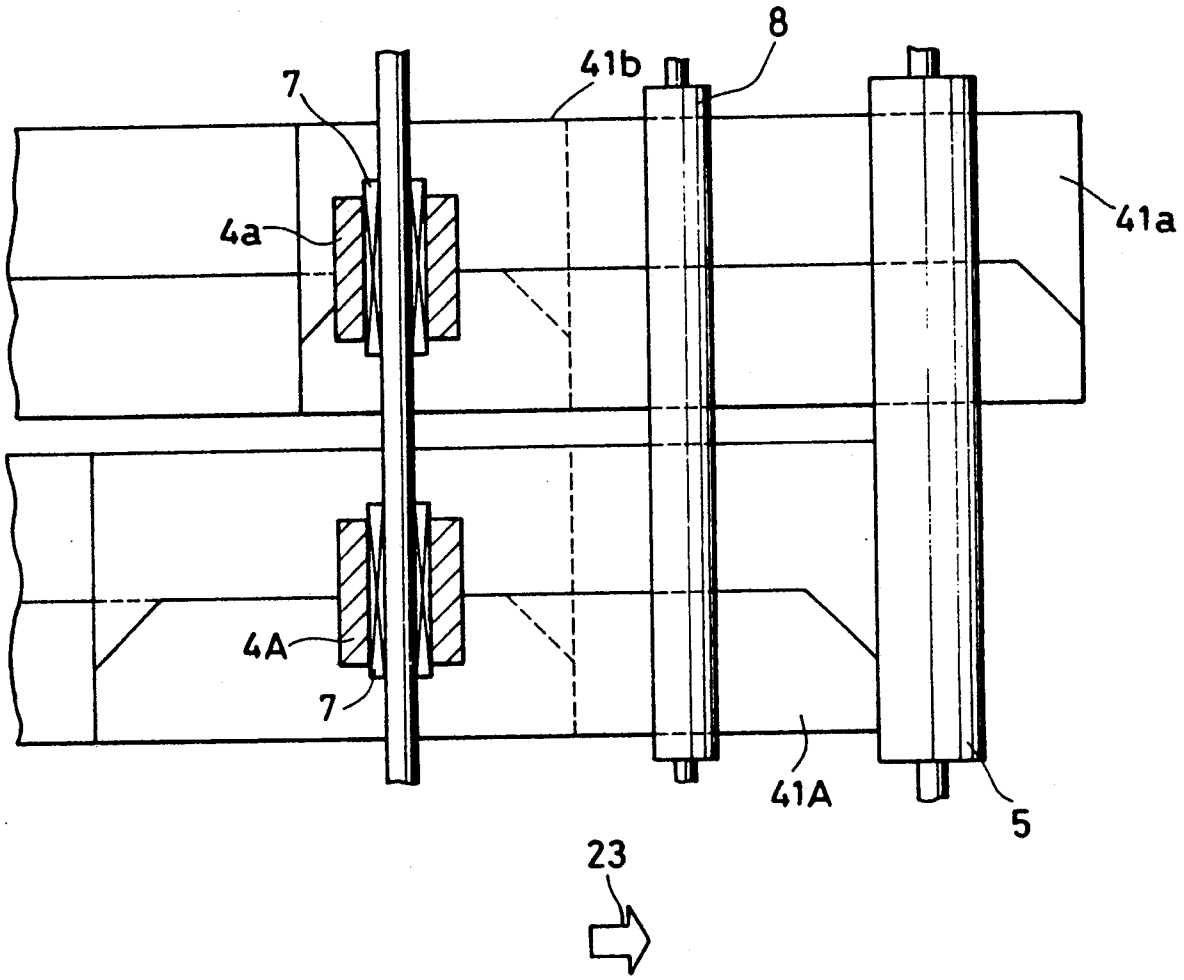
FIG. 8 is a diagram showing transport paths of the second sheet transport device which are developed into a plane to show sheets in transported states thereof at time t9 in FIG. 7.

Similarly to the first embodiment, let it be assumed that the misalignment of two sheets 41*a*, 41A occurs due to some error caused by the feed roller 4 in dispensing the same and the sheets 41*a*, 41A are fed with the sheet 41A delayed relative to the other 41*a* as shown in FIG. 8. If the delayed sheet 41A passes the corresponding transport sensor 38 turning it on at time t8, the driving of the feed roller 4 is stopped at time t9 while the sheets 41*a*, 41A are both nipped by the feed roller 4 as shown in FIG. 8, and thereafter pulled forward by the still rotating transport rollers 5. At this time, due to the frictional force with the sheet 41A, a roller member 4A of the feed roller 4 in contact therewith is rotated in the direction 23 while the sheet 41A is pulled forward. Even if the sheet 41*a* is released from the roller member 4*a*, the sheet 41A is pulled while rotating only the roller member 4A in contact therewith. More specifically, even if the roller member 4A is rotated in the direction 23, the drive shaft 6 is not driven together therewith since the transmission of the rotational force thereof is shut off by the one-way clutch 7. As a result, only the roller member 4A is idly rotated. Accordingly, the sheet 41A is fed without dispensing a sheet 41*b* succeeding the sheet 41*a* from the corresponding container.

In this way, in the sheet transport device provided with the feed roller 4 having a plurality of roller members, there is provided between each roller member and the drive shaft 6 a clutch 7 for transmitting the rotational force of the drive shaft 6 driven in a sheet transport direction 23 to the feed roller 4 and for shutting off transmission of the rotational force of the drive shaft 6 driven in the reverse direction to the feed roller 4. Accordingly, the roller members are simultaneously rotated by actuating the drive means for rotating the drive shaft 6 and thereby a plurality of sheets can be fed side by side. In addition, even in the case where one of the plurality of sheets is delayed relative to the others, the roller member in contact with the delayed sheet is caused to rotate idly and thereby the delayed sheet can be fed without adversely affecting transport of the other sheets. Hence, succeeding sheets can be dispensed with neatly aligned.

Next, a third embodiment of the invention will be described with reference to FIG. 9.

Figure 9:
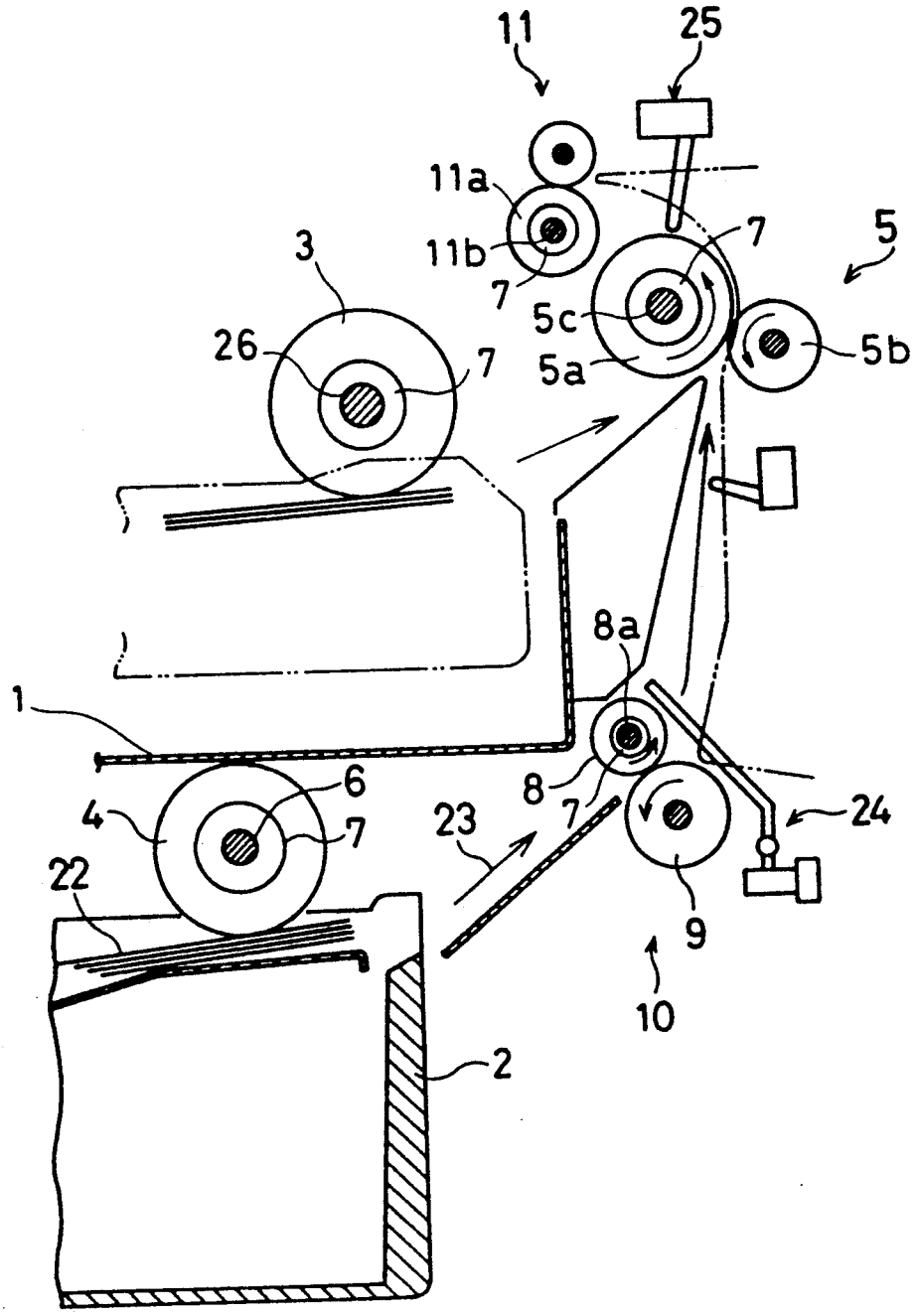
FIG. 9 is a diagram showing essential parts of an image forming apparatus incorporating a third sheet transport device in accordance with the invention.
Figure 10:
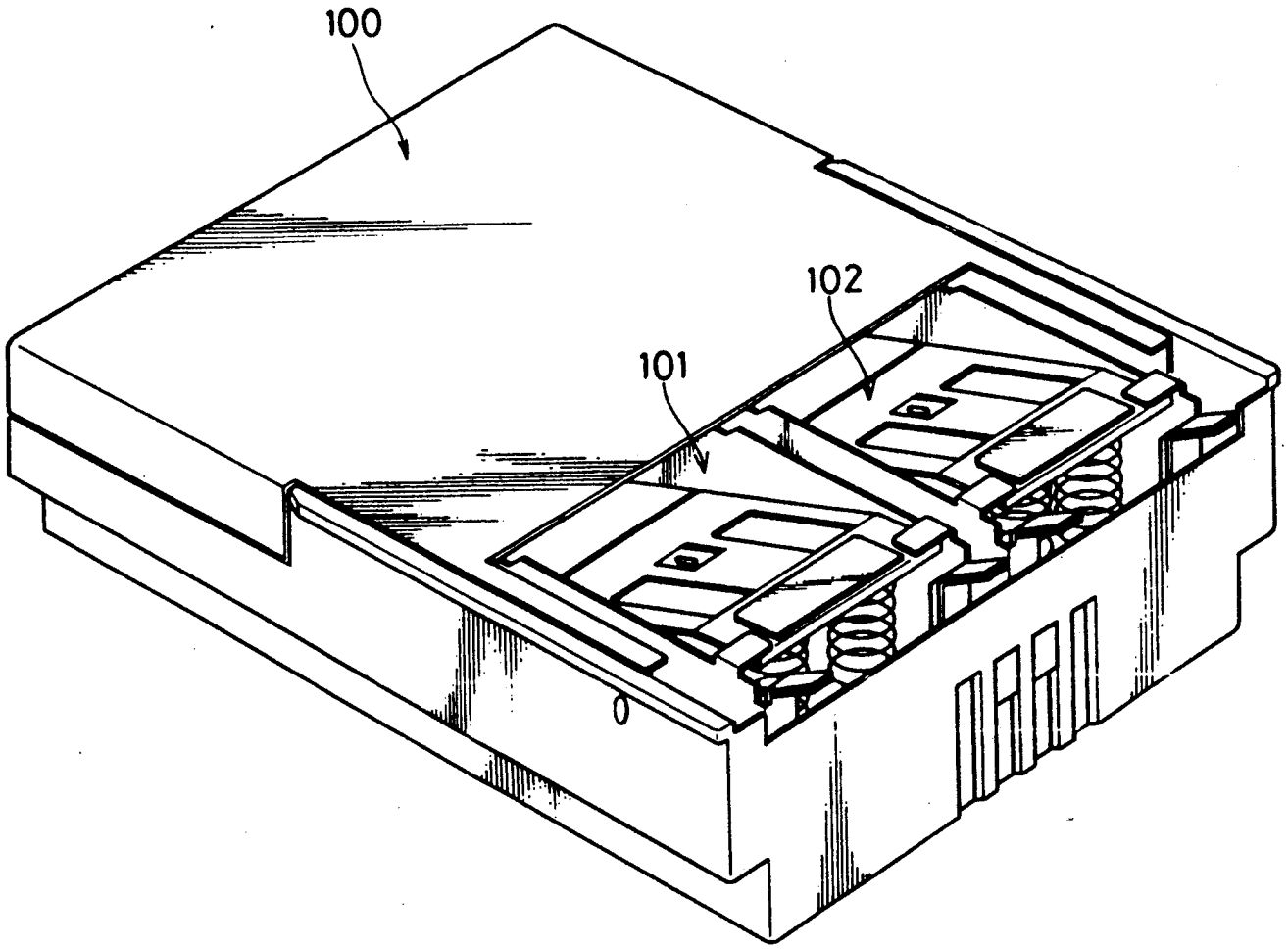
FIG. 10 is a perspective view showing a cassette.
Figure 11:
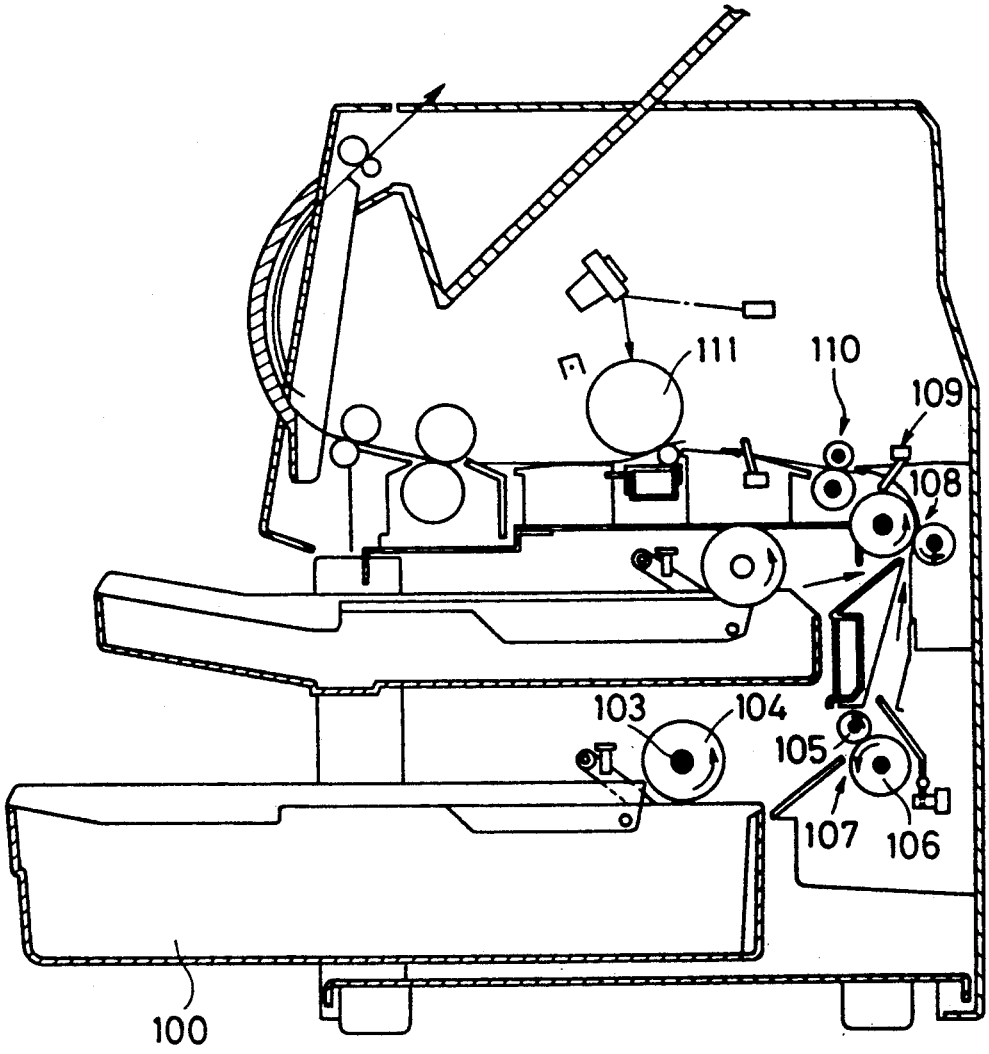
FIG. 11 PRIOR ART
FIG. 11 is a schematic diagram showing a construction of an image forming apparatus incorporating a sheet transport device of prior art.
Figure 12:
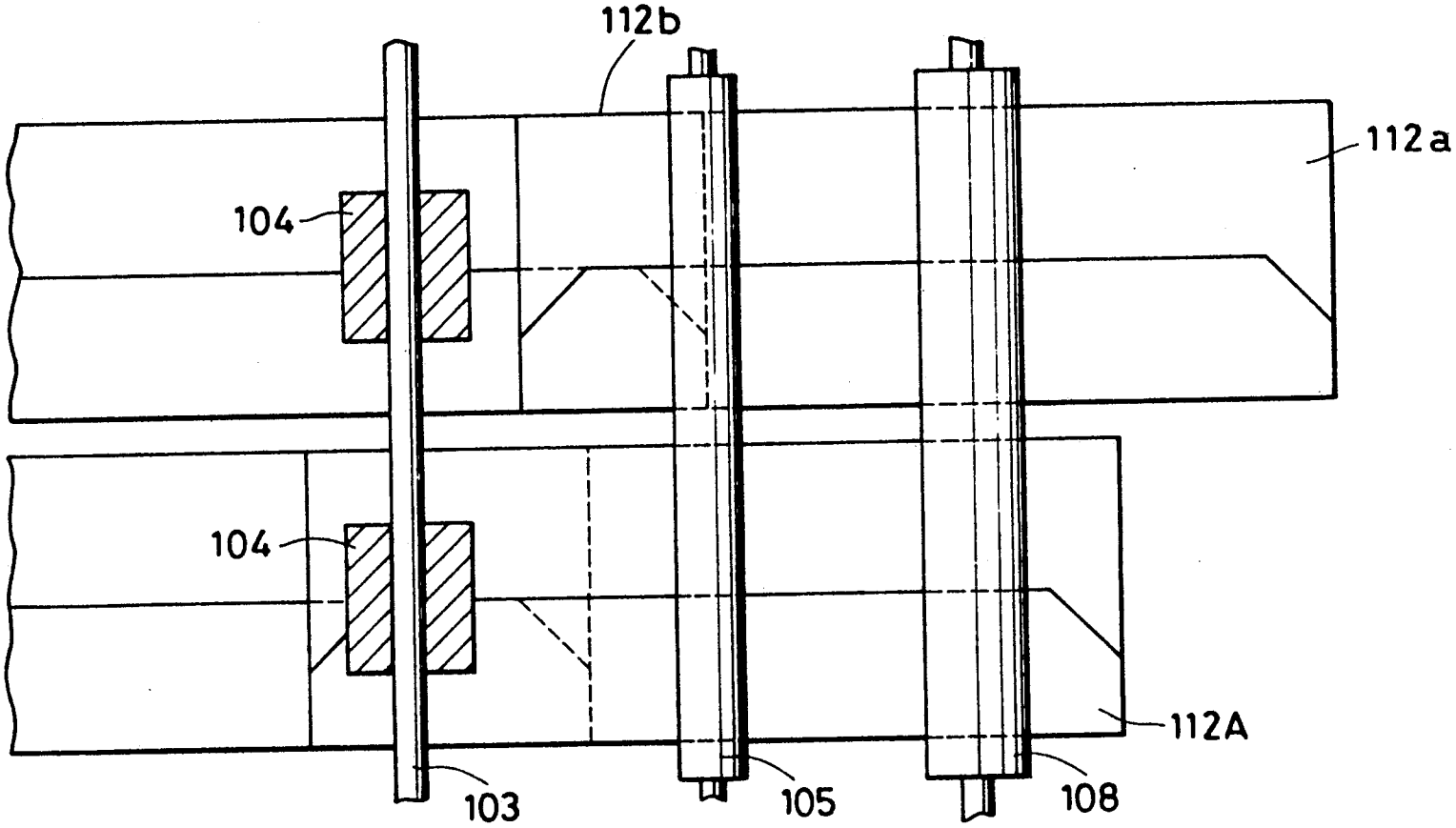
FIG. 12 PRIOR ART
FIG. 12 is a diagram showing transport paths of the prior art sheet transport device which are developed into a plane to show sheets in transported states thereof.

FIG. 9 is diagram showing essential parts of an image forming apparatus incorporating a third sheet transport device in accordance with the invention.

Like numerals designate like parts since basic construction of an image forming apparatus incorporating the third sheet transport device is similar to that of the first embodiment. As shown in FIG. 9, a plurality of roller pairs are provided along sheet transport paths between cassettes 1, 2 and registration roller pair 11 in addition to feed rollers 3, 4. Each of these rollers is mounted on a drive shaft. One of each roller pair as well as feed rollers 3, 4 includes two roller members transversely arranged with spaced apart along the respective drive shafts, and the aforementioned one-way clutch 7 is provided between each roller member and its drive shaft. More specifically, the one-way clutches 7 are provided between a forward roller 8 of a separating roller pair 10 and a drive shaft 8*a*, between the feed roller 3 and a drive shaft 26, between a roller 5*a* of a transport roller pair 5 and a drive shaft 5*c*, and between, for example, a lower roller 11*a* of a registration roller pair 11 and a drive shaft 11*b*. The roller 5*a* rotates in the sheet transport direction 23 when the transport roller pair 5 function as separating roller pair.

With the sheet transport device thus constructed, in the case where the driving of the shaft 8*a* is stopped while the sheets are nipped by the separating rollers 10 upon detection of a jam by means of, for example, an unillustrated jam sensor, an operator can remove a jammed sheet in the following manner. Firstly, the aforementioned cover 39 defining the transport paths is moved to open up the transport paths. Then, the jammed sheet is pulled toward the sheet transport direction 23 and removed. At this time, only the roller member of the forward roller 8 in contact with the jammed sheet is idly rotated while smoothly removing the jammed sheet.

The advantageous effect as described above is also obtainable when a jam occurs at the feed roller 3, transport rollers 5, and registration rollers 11.

In the foregoing embodiments, an inner ring cam roller clutch is applied as a one-way clutch. However, the invention does not limit the type of a clutch in use. For example, a sprag clutch or the like may be used as a one-way clutch. Alternatively, an electromagnetic clutch or the like may be used to transmit the rotational force in a specified manner.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A sheet transport device comprising:

at least first and second sheet transport path means extending parallel to one another; and transport means for transporting sheets along said first and second sheet transport means, the transport means including:

a single drive shaft extending normal to said first and second sheet transport path means;

roller means mounted on the drive shaft in a position corresponding to each of the first and second sheet transport path means, each roller means being rotatable in a sheet transport direction independently of rotation of said single drive shaft; and transmission including a one-way clutch means provided between the drive shaft and roller means for transmitting rotational force of the drive shaft rotating in a sheet transport direction to the roller means and for shutting off transmission of the rotational force of the roller means rotating in the sheet transport direction to the drive shaft.

2. A sheet transport device as defined in claim 1 further comprising container means for containing sheets therein wherein the transport means dispenses the sheet from the container means.

* * * * *